US006401456B1

(12) United States Patent
Moriya et al.

(10) Patent No.: US 6,401,456 B1
(45) Date of Patent: Jun. 11, 2002

(54) METHOD AND DEVICE FOR CONTROLLING WORK MACHINE

(75) Inventors: Naoyuki Moriya; Hideto Furuta; Nobuaki Matoba, all of Tokyo (JP)

(73) Assignee: Shin Caterpillar Mitsubishi Ltd. (JP)

( * ) Notice: Subject to any disclaimer, the term of this patent is extended or adjusted under 35 U.S.C. 154(b) by 0 days.

(21) Appl. No.: 09/485,021

(22) PCT Filed: May 10, 1999

(86) PCT No.: PCT/JP99/02403

§ 371 (c)(1),
(2), (4) Date: Jun. 8, 2000

(87) PCT Pub. No.: WO00/04293

PCT Pub. Date: Jan. 27, 2000

(30) Foreign Application Priority Data

Jul. 15, 1998 (JP) ..... 10-200622

(51) Int. Cl.[7] ..... F15B 13/16
(52) U.S. Cl. ..... 60/433; 91/361
(58) Field of Search ..... 60/433; 91/361, 91/459

(56) References Cited

U.S. PATENT DOCUMENTS 5,457,960 A * 10/1995 Morishita ..... 91/361

FOREIGN PATENT DOCUMENTS

JP 06058307 A * 3/1994

* cited by examiner

*Primary Examiner*—Edward K. Look
*Assistant Examiner*—Thomas E. Lazo
(74) *Attorney, Agent, or Firm*—Morrison Law Firm

(57) ABSTRACT

An electro-hydraulic transducing valve (3*a*) and other elements associated with cylinder-controlling components, such as a control valve (3), are connected to the output end of a controller (23) adapted to perform control computation based on electric manipulation signals send from and electric joy stick (12*a*) or the like. Control valve return pressure ($P_T$) and load-sensing pressure ($P_L$) are detected by the first and second detectors (18), (19) so that start-up of a hydraulic cylinder (7) or the like is detected based on rise of the differential pressure (ΔP) between the two types of pressures. The controller (23) is provided with a function generating unit (14*a*) and a calibration computing unit (20). The function generating unit (14*a*) has a reference function (F) that determines the relationship between electric manipulation signals and command values for commanding the electro-hydraulic transducing valve (3*a*) and other similar elements. The calibration computing unit (20) is adapted to correct the reference function (F) by computing the calibration deviation (ΔS) between the actual command value stored at the moment with the cylinder actually started and the provisional command value that corresponds to an imaginary start-up moment of the cylinder and has been set beforehand according to the reference function (F), and adding the calibration (ΔS) to the reference function (F).

4 Claims, 6 Drawing Sheets

Prior Art

METHOD AND DEVICE FOR CONTROLLING WORK MACHINE

TECHNICAL FIELD

The present invention relates to a method of controlling a work machine equipped with an electronically controlled load-sensing hydraulic system and a control apparatus used for such a method.

BACKGROUND OF THE INVENTION

FIG. 6 shows an example of conventional electronically controlled load-sensing hydraulic systems installed in a work machine, such as a hydraulic shovel.

Referring to FIG. 6, numeral 1 denotes a motor mounted on a work machine. A variable-capacity type hydraulic pump 2 adapted to be driven by the motor 1 is equipped with a slanted plate control mechanism 2*a* for controlling the pump output rate. The respective inlet ports of control valves 3,4, which are adapted to change the direction of the hydraulic oil fed by the hydraulic pump 2, are connected to the discharge opening of the hydraulic pump 2. Hydraulic cylinders 7,8, each of which functions as a hydraulic actuator, are respectively connected to the outlet ports of the control valves 3,4. The hydraulic cylinder 7 is connected to the control valve 3 via pressure compensation valves 5*a*,5*b* adapted to maintain a constant differential pressure between the inlet and the outlet of the control valve 3, while the hydraulic cylinder 8 is connected to the control valve 4 via pressure compensation valves 6*a*,6*b* adapted to maintain a constant differential pressure between the inlet and the outlet of the control valve 4.

An unload valve 9 for releasing the hydraulic oil in the hydraulic pump 2 when the control valves 3,4 are at the neutral position is connected to a pipe line extending from the hydraulic pump 2 to the inlet ports of the control valves 3,4.

Each control valve 3,4 has a port that is located at the center of the control valve as viewed in the drawing. An inlet of a shuttle valve 10 adapted to select the higher pressure between the load pressures respectively introduced from the two control valves 3,4 is connected via pipe lines L1,L2 to the aforementioned ports of the control valves 3,4. When the control valves 3,4 are at the neutral position, the inlet of the shuttle valve 10 communicates with a tank 11.

A pipe line L3 links the outlet of the shuttle valve 10 with respective pilot operation units of the aforementioned slanted plate control mechanism 2*a* of the hydraulic pump 2, the pressure compensation valves 5*a*,5*b*,6*a*,6*b* and the unload valve 9.

The slanted plate control mechanism 2*a* is provided with a control valve 2*a*1 and an actuator 2*a*2. The control valve 2*a*1 is adapted to control the flow of the hydraulic oil so as to maintain the balance between the discharge pressure of the hydraulic pump 2 and the sum of the higher load pressured selected by the aforementioned shuttle valve 10 (hereinafter called 'the load-sensing pressure') and the pressure set by means of a spring. The actuator 2*a*2 is adapted to be operated by the pressure oil fed through the control valve 2*a*1 so as to control the angle of inclination of the slanted plate of the hydraulic pump 2.

Electric joy sticks 12*a*,12*b* serving as an operating device to be operated by the operator are connected to the input end of a controller 13, which is adapted to perform control and computation based on signals from the joy sticks 12*a*,12*b*. The output end of the controller 13 is connected to electro-hydraulic transducing valves 3*a*,3*b*,4*a*,4*b* attached to the control valves 3,4.

The control valves 3,4 are designed to be operated by the aforementioned electrohydraulic transducing valves 3*a*,3*b*, 4*a*,4*b* so as to control the direction and the flow rate of the hydraulic oil fed from the hydraulic pump 2 to the hydraulic cylinders 7,8 of the work machine.

The electro-hydraulic transducing valves 3*a*,3*b* of one of the two control valves, i.e. the control valve 3, is adapted to be controlled by the electric joy stick 12*a*, while the electro-hydraulic transducing valves 4*a*,4*b* of the other control valve, i.e. the control valve 4, is adapted to be controlled by the electric joy stick 12*b*.

FIG. 7 is a control block diagram of a conventional controller 13. In FIG. 7, the aforementioned electric joy sticks 12*a*,12*b* are connected to function generating units 14*a*,14*b*,15*a*,15*b* that are adapted to set command signals to electro-hydraulic transducing valves 3*a*,3*b*,4*a*,4*b* based on electric manipulation signals, which are electric signals input from the electric joy sticks 12*a*,12*b* and represent degree of manipulation of the electric joy sticks 12*a*,12*b*. Via drivers 16*a*,16*b*,17*a*,17*b* that are adapted to drive the electro-hydraulic transducing valves 3*a*,3*b*,4*a*,4*b*, the function generating units 14*a*,14*b*,15*a*,15*b* are respectively connected to the solenoid portions of the electro-hydraulic transducing valves 3*a*,3*b*,4*a*,4*b*.

The electronically controlled load-sensing hydraulic system described above has a configuration such that operating the electric joy sticks 12*a*,12*b* causes command signals to the electro-hydraulic transducing valves 3*a*,3*b*,4*a*,4*b* to be set by the function generating units 14*a*,14*b*,15*a*,15*b* in the controller 13 so that the drivers 16*a*,16*b*,17*a*,17*b* drive the electro-hydraulic transducing valves 3*a*,3*b*,4*a*,4*b*, thereby driving the control valves 3,4.

When the pressure oil has been fed to the hydraulic cylinders 7,8 as a result of the operation of the control valves 3,4, load pressures are respectively applied from the control valves 3,4 through the pipe lines L1,L2 to the shuttle valve 10, by which the higher load pressure is selected to act as the load-sensing pressure and directed through the pipe line L3 to the slanted plate control mechanism 2*a* of the hydraulic pump 2, the pressure compensation valves 5*a*,5*b*,6*a*,6*b* and the unload valve 9.

As the load-sensing pressure selected by the shuttle valve 10 is directed to the control valve 2*a*1 of the slanted plate control mechanism 2*a* of the hydraulic pump 2, the discharge pressure of the hydraulic pump 2 is set such that it is higher by a predetermined reference pressure than the load-sensing pressure.

As the pressure compensation valves 5*a*,5*b*,6*a*,6*b* maintain a constant differential pressure between the inlet and the outlet of the control valve 3 and a constant differential pressure between the inlet and the outlet of the control valve 4, pump flow rate that are respectively in proportion to the aperture areas of the control valves 3,4 are distributed to the hydraulic cylinders 7,8.

The conventional electronically controlled load-sensing hydraulic system described above presents a problem in that differences among individual elements actually used as the drivers 16*a*,16*b*,17*a*,17*b*, electro-hydraulic transducing valves 3*a*,3*b*,4*a*,4*b* or control valves 3,4 produce a variance in signals from the electric joy sticks 12*a*,12*b* when the hydraulic cylinders 7,8 start to operate.

In order to solve the above problem, an object of the present invention is to provide a method of controlling a work machine, wherein said method is capable of preventing differences among the individual elements of the control system that is adapted to control the hydraulic actuators based on electric manipulation signals from producing a variance in said electric manipulation signals at the actuation of the hydraulic cylinders. Another object of the invention is to provide a control apparatus used for said control method.

DISCLOSURE OF THE INVENTION

A method of controlling a work machine according to the present invention relates to a method of controlling a work machine by inputting electric manipulation signals into function generating units and controlling control valves of a hydraulic circuit that is adapted to drive hydraulic actuators of the work machine based on command values output from said function generating units, wherein said control methods includes a process comprised of computing calibration deviations, each of which is computed based on the difference between the command value corresponding to an imaginary start-up moment of a hydraulic actuator, said command value being a provisional value on a reference function that has been set beforehand in the corresponding function generating unit, and the actual command value stored at the moment when said hydraulic actuator was actually started; setting corrected functions in the respective function generating units by adding the calibration deviations computed as above to the respective reference functions; and controlling said control valves based on the command values that have been changed by using the corrected functions.

As described above, the control method of the invention calls for computing calibration deviations based on the differences between the command values corresponding to imaginary start-up moments of the respective hydraulic actuators, said command values being provisional values on reference functions that have respectively been set beforehand in the function generating units, and the actual command values stored when said hydraulic actuators were actually started; setting corrected functions in the respective function generating units by adding the calibration deviations to the respective reference functions; and controlling said control valves based on the command values that have been changed by using the corrected functions. By thus using corrected functions in the function generating units, the control method of the invention eliminates the variance produced in electric manipulation signals as a result of differences among the individual elements actually used in the control system for controlling the hydraulic actuators of the work machine based on said electric manipulation signals, in other words differences among the individual control valves disposed between the function generating units, the hydraulic actuators or the like. The method of the invention thus ensures uniform operation.

According to another feature of the invention, the method of controlling a work machine calls for detecting load-sensing pressure at the load side and control valve return pressure generated in a return circuit, which is located closer to the tank than are the control valves; computing a differential pressure between the load-sensing pressure and the control valve return pressure; and computing a calibration deviation based on the difference between the provisional command value on the reference function, said provisional command value corresponding to an imaginary start-up moment of the hydraulic actuator associated therewith, and the command value stored at the moment when the aforementioned differential pressure rose, which moment is regarded as the actual start-up moment of the hydraulic actuator.

By using the moment when the differential pressure between the load-sensing pressure and the control valve return pressure rises, reliable recognition of the actual start-up moment of a hydraulic actuator is ensured.

According to yet another feature of the invention, the method of controlling a work machine calls for regarding the moment when the differential pressure between the load-sensing pressure and the control valve return pressure exceeds a given reference pressure which is constant and slightly greater than zero as the moment when the differential pressure rises.

As a constant reference pressure slightly greater than zero is used as the standard of determination, the invention is capable of accurately judging the state of rising of the differential pressure at the moment when the differential pressure exceeds the reference pressure and storing the command value at that moment. Thus, the invention is capable of computing an accurate calibration deviation.

A work machine control apparatus according to the invention includes a hydraulic pump, an operating unit adapted to output electric manipulation signals, a controller adapted to perform control computation based on electric manipulation signals sent from the operating unit, electro-hydraulic transducing valves connected to the output end of the controller, control valves adapted to be driven by the electro-hydraulic transducing valves so as to control the hydraulic oil fed from the hydraulic pump to hydraulic actuators of the work machine, and a detecting means for detecting the actual start-up moment of the hydraulic actuators, wherein the controller is provided with function generating units, drivers and calibration computing units such that each function generating unit has a reference function that incorporates the relationship between an electric manipulation signal and a command value to the corresponding electro-hydraulic transducing valve, each driver is adapted to drive the corresponding electro-hydraulic transducing valve based on the output from the corresponding function generating unit, and that each calibration computing unit is adapted to correct the corresponding reference function. Each calibration computing unit is adapted to store the command value sent to the corresponding electro-hydraulic transducing valve at the moment when the corresponding hydraulic actuator was actually started, i.e. the actual start-up moment detected by the aforementioned detecting means; compute a calibration deviation based on the difference between the stored command value and the provisional command value corresponding to an imaginary start-up moment of the hydraulic actuator associated therewith, said provisional command value set beforehand by using the reference function in the corresponding reference function generating unit; and set the corrected function in the reference function generating unit by adding said calibration deviation to the reference function.

As described, above each calibration computing unit of the controller of the work machine control apparatus according to the invention stores the command value sent to the corresponding electro-hydraulic transducing valve at the moment when the corresponding hydraulic actuator was actually started; computes a calibration deviation based on the difference between the stored command value and the provisional command value that corresponds to the start-up moment of the corresponding hydraulic actuator and has been set beforehand by using the reference function in the corresponding reference function generating unit; and sets the corrected function in the reference function generating unit by adding said calibration deviation to the reference function. Therefore, by means of the corrected functions in the reference function generating units, the control apparatus according to the invention is capable of eliminating the variance that has been produced in electric manipulation signals sent from the operating units at the start-up of the hydraulic actuators as a result of the differences among the individual elements actually used in the control system for controlling the hydraulic actuators of the work machine based on said electric manipulation signals, in other words the differences among the individual drivers, the electro-hydraulic transducing valves or the control valves, which are disposed between the function generating units and the hydraulic actuators. Thus, the control apparatus of the invention ensures uniform operation.

According to yet another feature of the invention, the detecting means for detecting the start-up moments of the hydraulic actuators of the work machine control apparatus includes a first pressure detector and a second pressure detector, wherein the first pressure detector is adapted to detect control valve return pressure generated in the return circuit from the control valves, while the second pressure detector is adapted to detect load-sensing pressure at the load side; and each calibration computing unit is adapted to compute the differential pressure between a load-sensing pressure and a control valve return pressure of the corresponding control valve and regard the moment when the differential pressure exceeds a given, constant reference pressure that has been set slightly greater than zero as the actual start-up moment of the corresponding hydraulic actuator.

When a hydraulic actuator is at a standstill, the differential pressure between the load-sensing pressure and the control valve return pressure respectively detected by the two pressure detectors is zero. Therefore, the current state of the hydraulic actuator can be reliably determined by means of the aforementioned reference pressure, which is set slightly greater than zero.

PREFERRED EMBODIMENT OF THE INVENTION

Next, an embodiment of the present invention is explained hereunder, referring to FIGS. 1 through 5.

Figure 1:
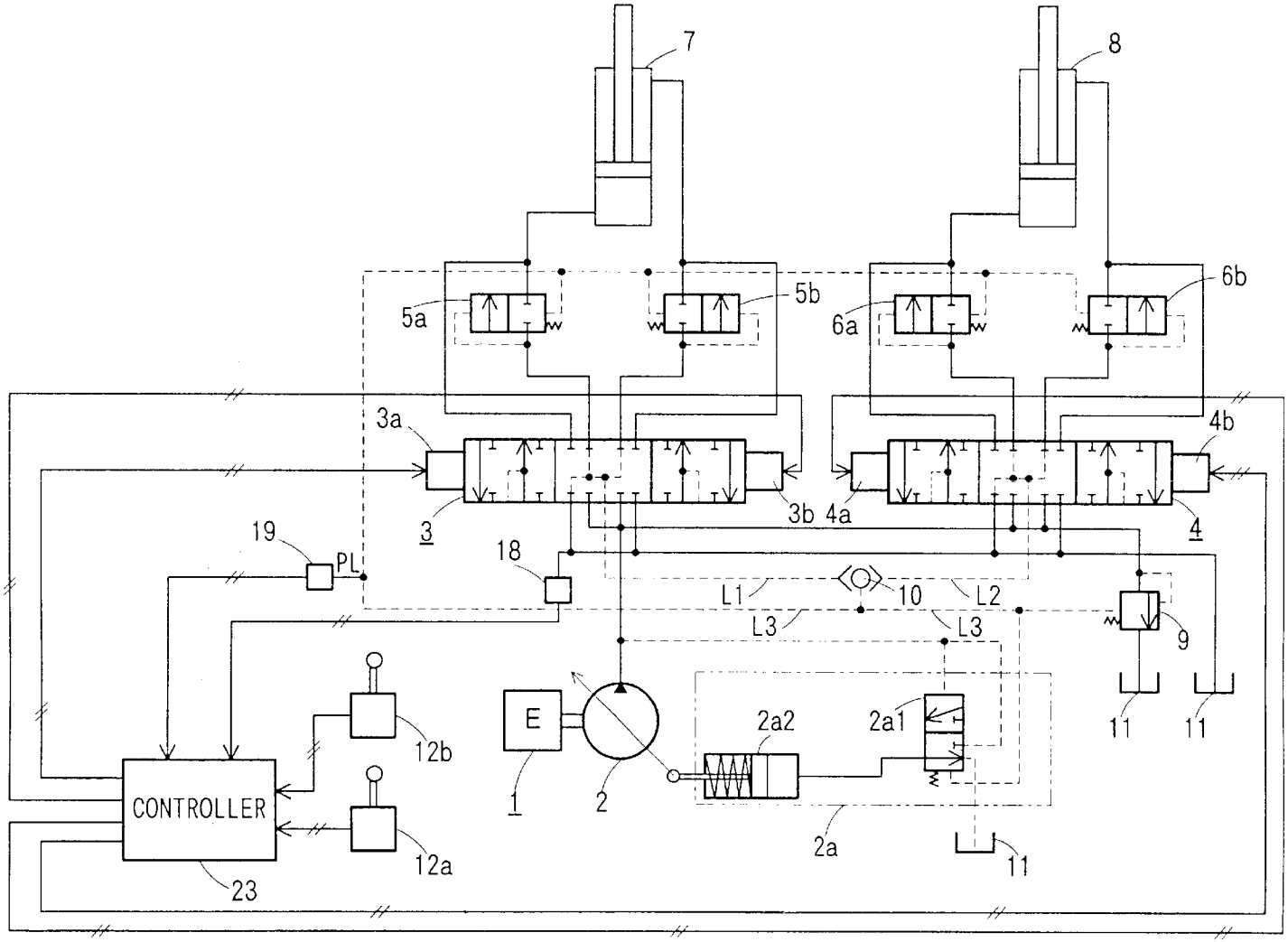
FIG. 1 is an electro-hydraulic circuit diagram of an electronically controlled load-sensing hydraulic system, which is an embodiment of the present invention.
Figure 6:
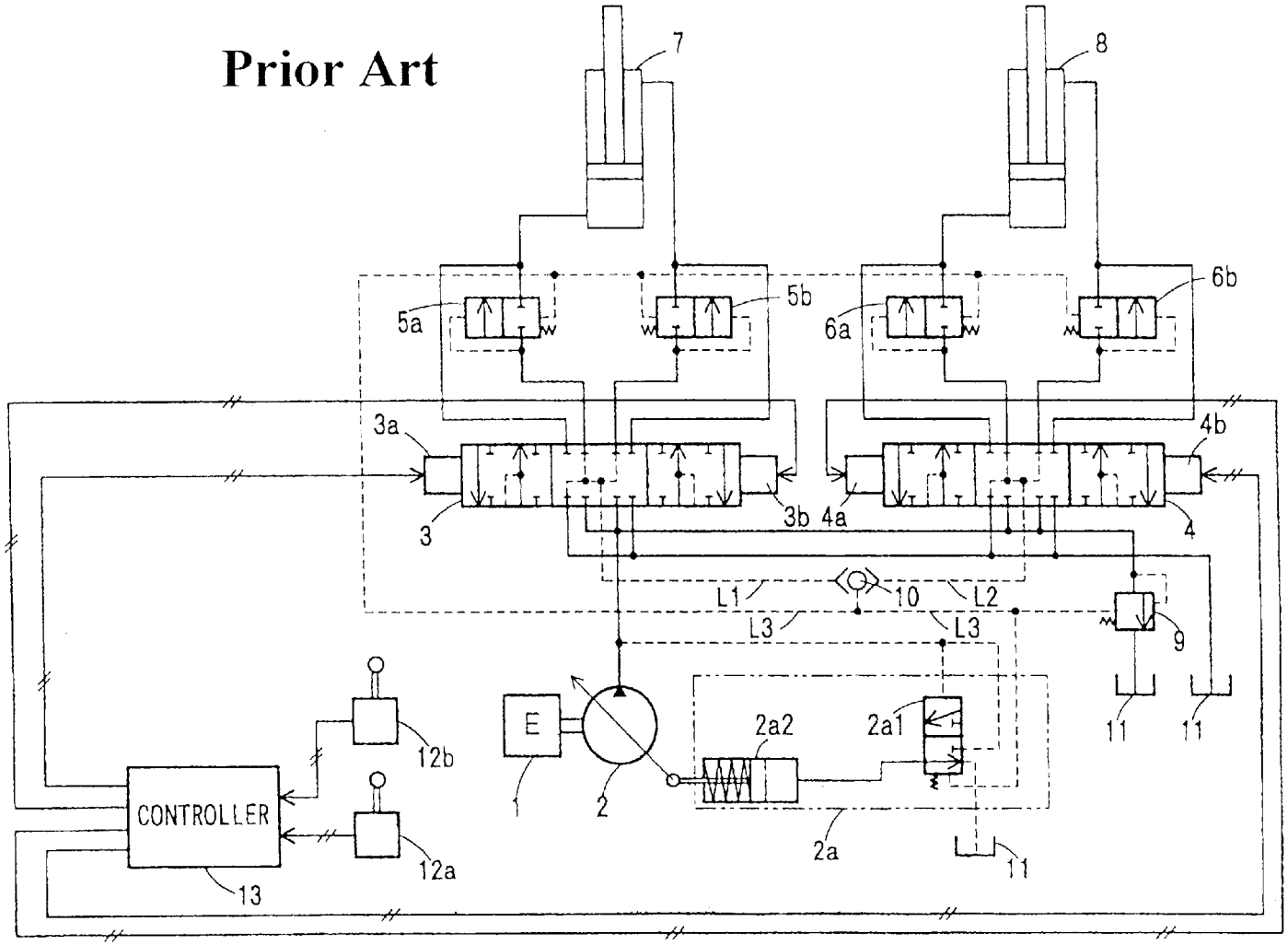
FIG. 6 is an electro-hydraulic circuit diagram of an example of conventional electronically controlled load-sensing hydraulic systems.
Figure 7:
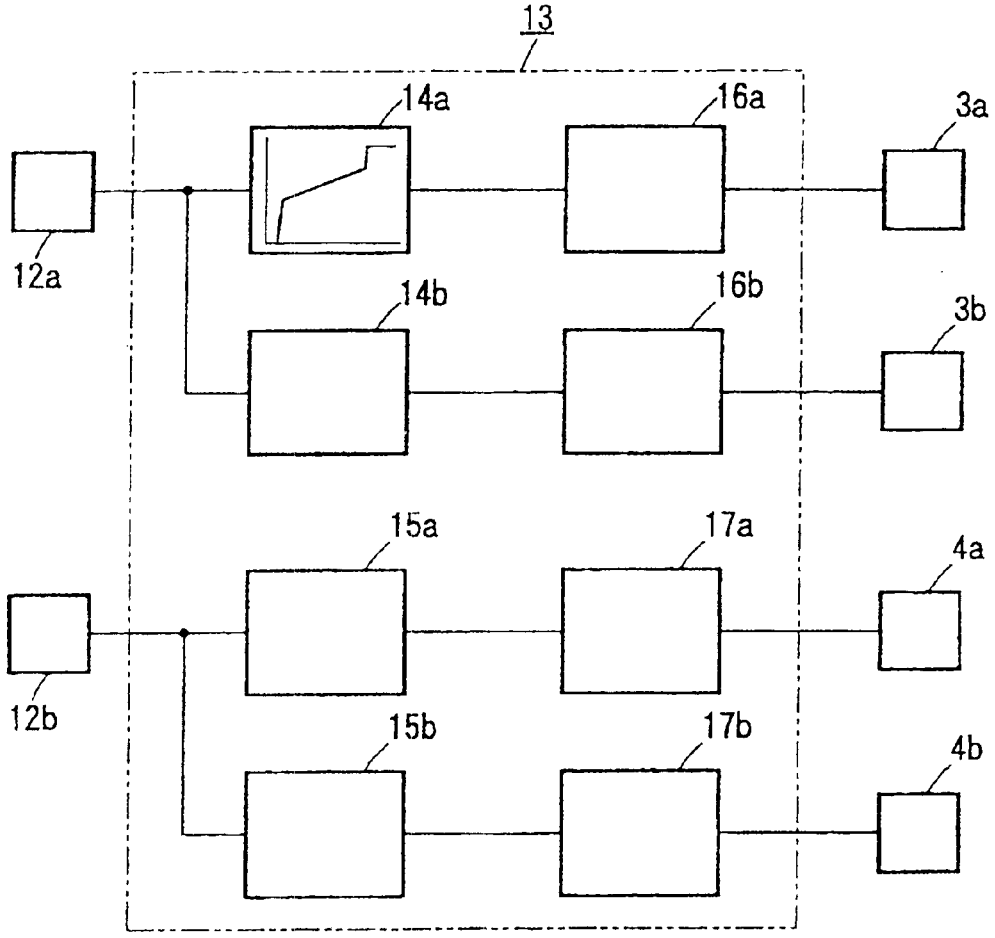
FIG. 7 is a block diagram of a control computation block of a controller in said conventional hydraulic system.

FIG. 1 shows an electronically controlled load-sensing hydraulic system according to the present invention installed in a work machine, such as a hydraulic shovel. As the basic load-sensing circuit of this hydraulic system is the same as the conventional load-sensing circuit shown in FIG. 6, the same elements as those of the conventional circuit are identified with the same reference numerals, and their explanation is omitted.

In addition to the aforementioned basic load-sensing circuit, a first pressure detector 18 and a second pressure detector 19 are provided for calibration of the system. The first pressure detector 18, which serves to detect control valve return pressure $P_T$ generated in the return circuit from the control valves 3,4 to the tank 11, is attached to a return pipe line that is disposed closer to the tank 11 than are the control valves 3,4, while the second pressure detector 19 is attached to a pipe line L3 at the output side of a shuttle valve 10 and serves to detect load-sensing pressure $P_L$, which is the higher load pressure selected by the shuttle valve 10. The signal output units of the pressure detectors 18,19 are connected to a controller 23.

The controller 23 is adapted to control the hydraulic oil fed from a hydraulic pump 2 to hydraulic cylinders 7,8 that serve as hydraulic actuators. More precisely, based on electric manipulation signals input from electric joy sticks 12*a*,12*b* that serve as an operating unit, the controller 23 controls the hydraulic oil by performing calibration and computation of command values for electro-hydraulic transducing valves 3*a*,3*b*,4*a*,4*b* of the control valves 3,4 while monitoring pressure signals input from the pressure detectors 18,19, and then outputting drive command signals to the electro-hydraulic transducing valves 3*a*,3*b*,4*a*,4*b* of the control valves 3,4, which are connected to the output end of the controller 23, thereby driving the control valves 3,4.

Figure 2:
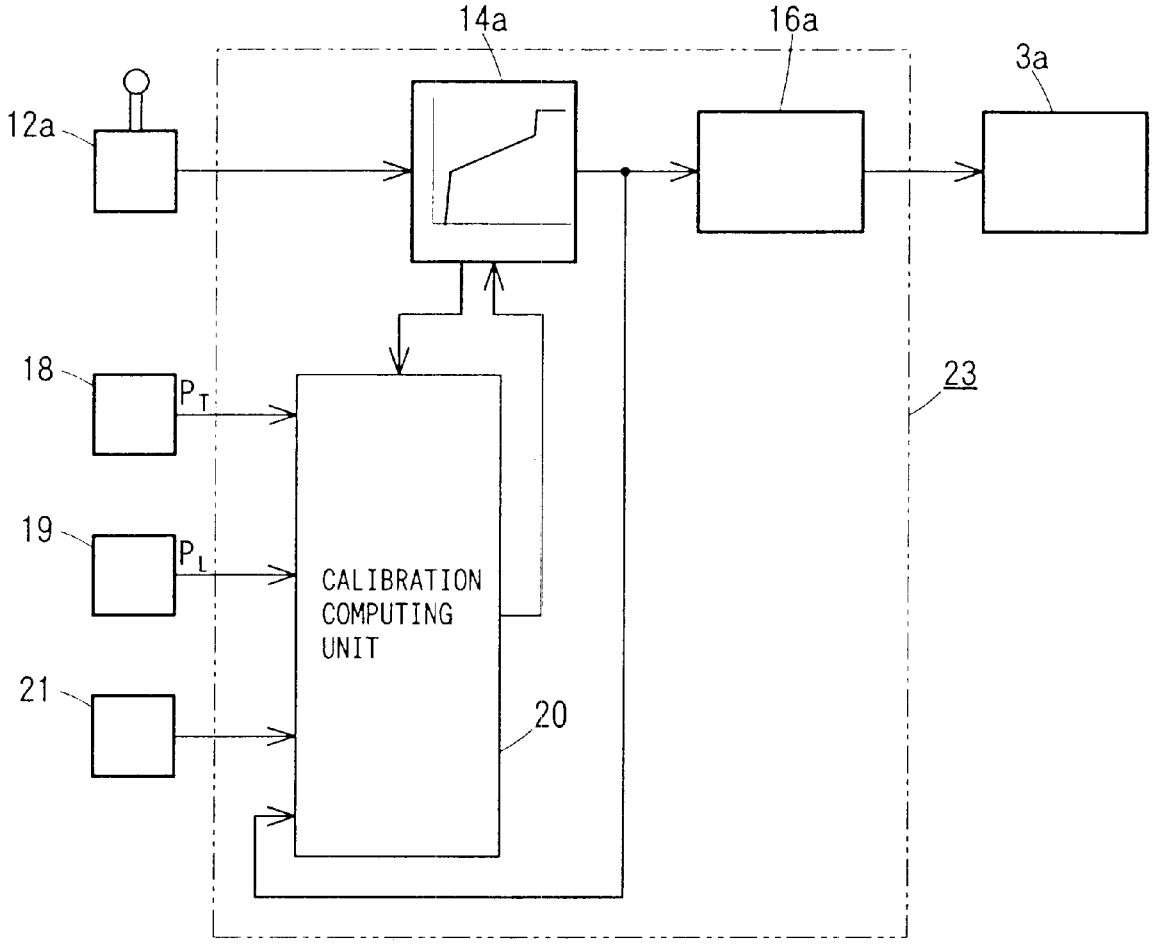
FIG. 2 is a block diagram of a control computation block of a controller in said hydraulic system.

FIG. 2 is a control computation block diagram of the controller 23 described above. The controller 23 is provided with a function generating unit 14*a*, a driver 16*a* and a calibration computing unit 20. The function generating unit 14*a* has a reference function in which the relationship between an electric manipulation signal input from said electric joy stick 12*a* and a command value to the electro-hydraulic transducing valve 3*a* is set. The driver 16*a* is adapted to drive the electro-hydraulic transducing valve 3*a* based on the output from the function generating unit 14*a*, and the calibration computing unit 20 serves to automatically correct the reference function set in the function generating unit 14*a*.

Referring to FIG. 2, the electric joy stick 12*a* is connected to the function generating unit 14*a*. The pressure detector 18 for detecting the aforementioned control valve return pressure $P_T$ and the pressure detector 19 for detecting load-sensing pressure $P_L$ are connected to the calibration computing unit 20. Also connected to the calibration computing unit 20 is a switch 21 for actuating the calibration computing unit 20.

The calibration computing unit 20 is connected to the function generating unit 14*a* so as to make use of or adjust a function in the function generating unit 14*a*. To be more specific, the calibration computing unit 20 serves to compute the differential pressure ΔP between the aforementioned load-sensing pressure $P_L$ and control valve return pressure $P_T$ as described later in detail, store the command value sent by the function generating unit 14*a* to the electro-hydraulic transducing valve 3*a* when the differential pressure ΔP exceeds a given constant reference pressure, compute the deviation based on the difference between the actual command value stored as above and a provisional command value corresponding to an imaginary start-up moment of the hydraulic cylinder, said provisional command value set beforehand based on the reference function set in the function generating unit 14*a*, and set the corrected function in the function generating unit 14*a* by adding the aforementioned calibration deviation to the reference function.

Although a control computation block diagram of only one electro-hydraulic transducing valve, i.e. the electro-hydraulic transducing valve 3*a*, is shown in FIG. 2, each one of the other electro-hydraulic transducing valves 3*b*,4*a*,4*b* is provided with elements similar to the set of the function generating unit 14*a*, the driver 16*a* and the calibration computing unit 20 arranged in the same configuration as the illustrated control computation block diagram. Their block diagrams, however, are not shown in the drawing.

In the control computation block described above, the provisional electro-hydraulic transducing valve command value corresponding to an imaginary start-up moment of the hydraulic cylinder is incorporated in the reference function that has been set in the function generating unit 14*a* beforehand. Therefore, when the system is operated, the calibration computing unit 20 computes a calibration deviation based on the difference between the aforementioned provisional electro-hydraulic transducing valve command value corresponding to an imaginary start-up moment of the hydraulic cylinder and the actual electro-hydraulic transducing valve command value that was stored when the hydraulic cylinder 7 was actually put into operation. The calibration computing unit then adds the calibration deviation to the reference function so as to set the corrected function in the function generating unit 14*a* and controls the aforementioned control valve 3 based on the command value that has been changed by using the corrected function.

At the moment when the hydraulic cylinder 7 is actually initiated, the load-sensing pressure $P_L$ at the load side and the control valve return pressure $P_T$ are detected, and the differential pressure ΔP between the load-sensing pressure $P_L$ and the control valve return pressure $P_T$ is computed, with the moment when said differential pressure ΔP rises regarded as the actual start-up moment of the hydraulic cylinder.

With regard to the definition of the aforementioned rising moment of the differential pressure ΔP, a reference pressure ΔPset, which is a constant value slightly greater than zero, is set so that the moment when said differential pressure ΔP exceeds the reference pressure ΔPset during operation of the hydraulic cylinder 7 is regarded as the rising moment of the differential pressure ΔP.

Figure 3:
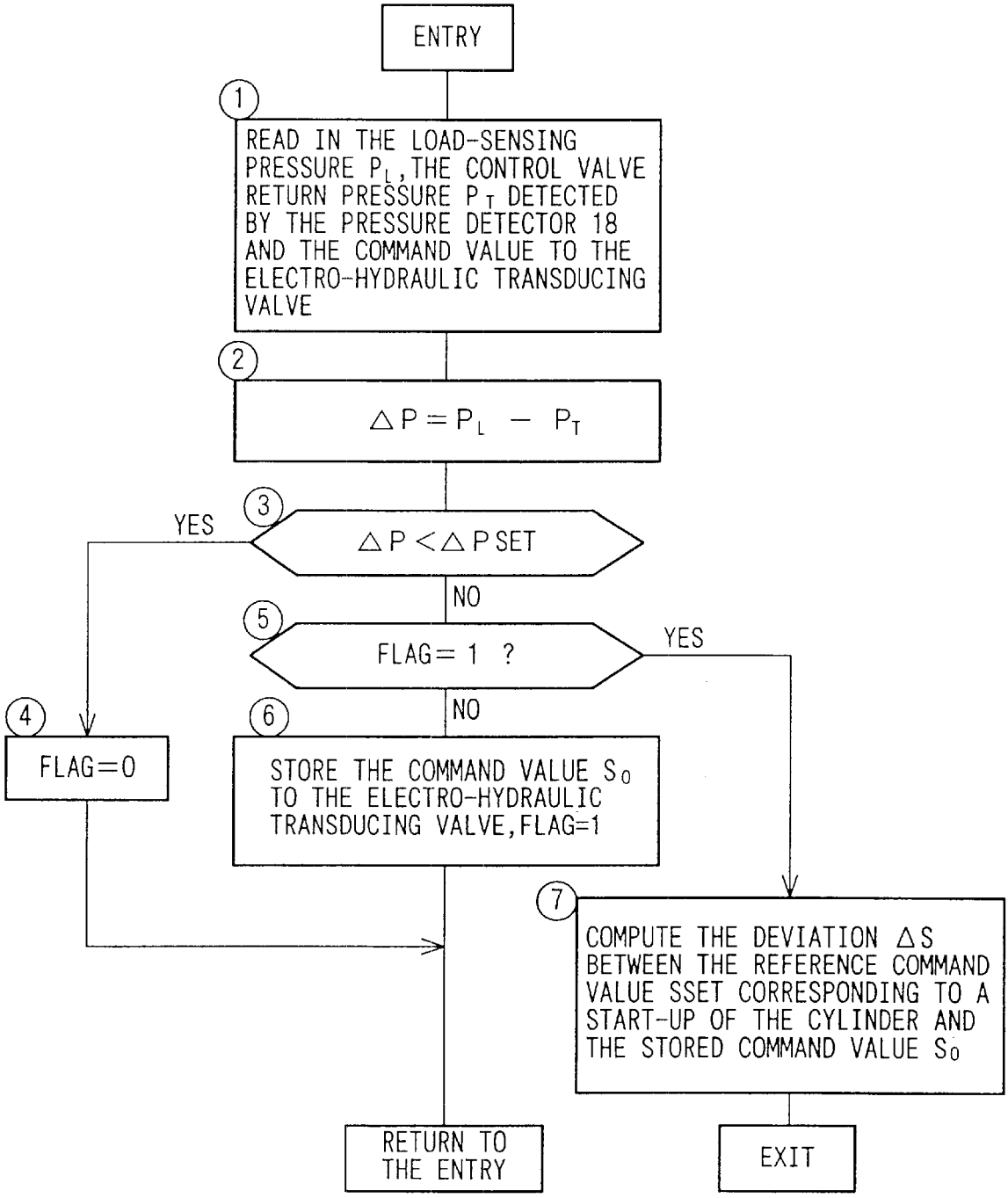
FIG. 3 is a flow chart representing a computing flow conducted by a calibration computing unit of said controller.
Figure 4:
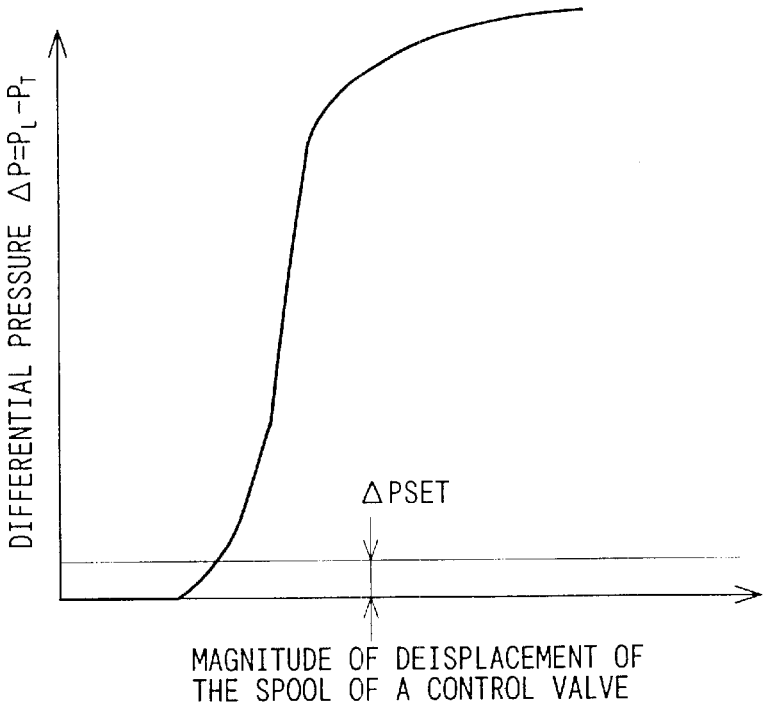
FIG. 4 is a characteristic diagram showing the relationship between magnitudes of displacement of the spool of a control valve and differential pressures ΔP of said control valve in the hydraulic system.
Figure 5:
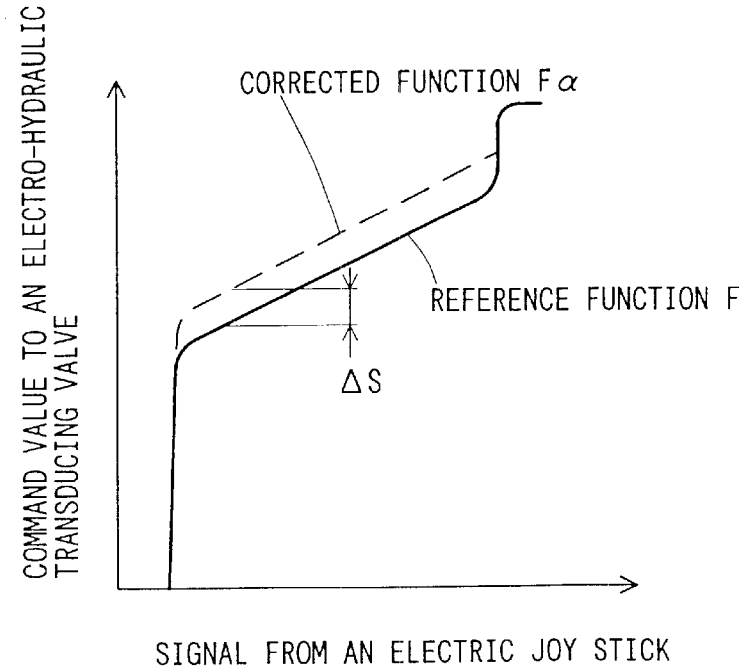
FIG. 5 is a characteristic diagram for explaining adjustment of characteristics of the function generating units of the aforementioned controller.

Next, how the embodiment shown in FIGS. 1 and 2 operates is explained hereunder, referring to FIGS. 3 through 5.

FIG. 3 is a flow chart representing the flow of computation performed by the calibration computing unit 20. The calibration computing unit 20 is actuated by operating the electric joy stick 12*a* alone when a switch 21 is in the 'on' state.

(Step 1)

The control valve return pressure $P_T$ detected by the pressure detector 18 and the load-sensing pressure $P_L$ detected by the pressure detector 19 are read into the calibration computing unit 20 that has been actuated as above. Meanwhile, the electro-hydraulic transducing valve command value output from the function generating unit 14*a*, too, is read into the calibration computing unit 20.

(Step 2)

Next, the differential pressure ΔP is computed by subtracting the control valve return pressure $P_T$ from the load-sensing pressure $P_L$.

FIG. 4 shows the relationship between magnitudes of displacement of the spool, which is a movable valve element of the control valve 3, and the aforementioned differential pressures ΔP. When the spool of the control valve 3 is at the neutral position, the load-sensing pressure $P_L$ is directed into the tank 11 as shown in FIG. 1 and therefore equal to the control valve return pressure $P_T$. Therefore, the differential pressure ΔP between the load-sensing pressure $P_L$ and the control valve return pressure $P_T$ is zero.

When the spool of the control valve 3 moves so that the hydraulic pump pressure which has been output from the hydraulic pump 2 is fed to the hydraulic cylinder 7 and that the hydraulic cylinder 7 starts, the load pressure in the hydraulic cylinder 7 becomes the load-sensing pressure $P_L$. The load-sensing pressure $P_L$ then exceeds the control valve return pressure $P_T$ so that the differential pressure ΔP rises as shown in FIG. 4.

It is to be noted that a certain reference pressure ΔPset has been set beforehand for the sake of convenience.

(Step 3)

As shown in FIG. 3, the aforementioned differential pressure ΔP is compared with the reference pressure ΔPset.

(Step 4)

In cases where the reference pressure ΔPset exceeds the differential pressure ΔP (ΔP<ΔPset), as in the case where the differential pressure ΔP is zero, the computing unit sets the flag at zero and proceeds to the next computing cycle.

(Step 5)

If the differential pressure ΔP rises in Step 3 mentioned above, i.e. (the differential pressure ΔP) >(the reference pressure ΔPset), the computing unit judges whether or not the flag is 1. As the flag is at zero in the present case, the unit proceeds to the next step, i.e. the step 6.

(Step 6)

The flag is set at 1, while the current command value So to command the electro-hydraulic transducing valve 3*a* is stored.

(Step 7)

As the differential pressure ΔP is greater than the reference pressure ΔPset in Step 3, the computing unit proceeds to Step 5. As the flag is set at 1 in Step 5, the computing unit further proceeds to Step 7, where the calibration deviation ΔS is computed based on the difference between the electro-hydraulic transducing valve command value Sset, which corresponds to an imaginary start-up moment of the hydraulic cylinder and has been set beforehand according to the reference function in the function generating unit 14*a*, and the actual electro-hydraulic transducing valve command value $S_0$ stored in Step 6. Having thus computed the calibration deviation ΔS, the computing unit exits the calibration computation routine, thereby terminating the calibration computation.

As shown in FIG. 5, the calibration deviation ΔS is added to the reference function F in the function generating unit 14*a* so that the corrected function Fα(=F+ΔS) is set. The corrected function Fαis the value that is produced by moving the reference function F in parallel by the distance of the calibration deviation ΔS. The corrected function Fαproduced as above is used as the function in the function generating unit 14*a* when the pump is being operated in normal conditions.

By using the corrected function Fαresulting from the calibration computation described above and stored in the function generating unit 14*a*, the present embodiment eliminates the problem of a variance that the differences among individual elements actually used as the driver 16*a*, the electro-hydraulic transducing valve 3*a* or the control valve 3 may produce in electric manipulation signals sent from the electric joy stick 12*a* when the hydraulic cylinder 7 is actuated In the same manner as above, the variance in electric manipulation signals sent from the electric joy stick 12*a*, which is produced by the differences among the individual elements actually used as the driver 16*b*, the electro-hydraulic transducing valve 3*b* or the control valve 3 at a start-up of the hydraulic cylinder 7 is also eliminated. The present embodiment also eliminates the variance that the differences among individual elements actually used as the driver 17*a*, the electro-hydraulic transducing valve 4*a* or the control valve 4 produce in electric manipulation signals sent from the electric joy stick 12*b* at a start-up of the hydraulic cylinder 8, as well as the variance that the differences among individual elements actually used as the driver 17*b*, the electro-hydraulic transducing valve 4*b* and/or the control valve 4 produce in electric manipulation signals sent from the electric joy stick 12*b* at a start-up of the hydraulic cylinder 8.

According to the embodiment shown in the drawings, the pressure detector 18 for detecting control valve return pressure $P_T$ and the pressure detector 19 for detecting load-sensing pressure $P_L$ are presented as examples of detecting units for detecting the start-up moments of the hydraulic cylinders 7,8, and each start-up moment of the hydraulic cylinder 7,8 is detected based on rise of the differential pressure between the load-sensing pressure $P_L$ and the control valve return pressure $P_T$. However, another embodiment of a detecting means to detect start-up moments of the hydraulic cylinders 7,8 may be employed; for example, a pump discharge sensor (not shown) for detecting pump discharge pressures may be provided in the pump discharge pipe line that extends from the hydraulic pump 2 to the control valves 3,4 so that the moment when the value detected by the pump discharge sensor exceeds a preset value is treated as a moment when the corresponding hydraulic cylinder 7,8 actually starts.

POSSIBLE INDUSTRIAL APPLICATION

As described above, a control method and a control apparatus according to the present invention may be widely used in a work machine equipped with an electronically controlled load-sensing hydraulic system. They are particularly suitable for use in a construction machine, such as a hydraulic shovel.

What is claimed is:

1. A method of controlling a work machine by inputting electric manipulation signals into function generating units and controlling control valves of a hydraulic circuit that is adapted to drive hydraulic actuators of the work machine based on command values input from said function generating units, wherein said work machine control method includes a process comprising:

computing calibration deviations, each of which is computed based on the difference between a command value corresponding to an imaginary start-up moment of a hydraulic actuator, said command value being a provisional value on a reference function that has been set beforehand in the function generating unit corresponding to said hydraulic actuator, and the actual command value stored at the moment when the hydraulic actuator was actually used;

setting the corrected functions in the respective function generating units by adding said calibration deviations to the respective reference functions;

controlling said control valves based on the command values that have been changed by using the corrected functions;

detecting load-sensing pressure at the load side and control valve return pressure generated in a return circuit, which is located closer to the tank than are the control valves;

computing a differential pressure between said load-sensing pressure and said control valve return pressure; and computing a calibration deviation based on the difference between the provisional command value on the reference function, said provisional command value corresponding to an imaginary start-up moment of the hydraulic actuator associated therewith, and the command value stored at the moment when the aforementioned differential pressure rose, which moment is regarded as the actual start-up moment of the hydraulic actuator.

2. A work machine control method as claimed in claim 1, wherein the moment when the differential pressure between the load-sensing pressure and the control valve return pressure exceeds a given reference pressure which is constant and slightly greater than zero is regarded as the moment when the differential pressure rises.

3. A work machine control apparatus including:

a hydraulic pump;

an operating unit adapted to output electric manipulation signals;

a controller adapted to perform control computation based on electric manipulation signals sent from said operating unit;

electro-hydraulic transducing valves connected to the output end of the controller;

control valves adapted to be driven by the electro-hydraulic transducing valves so as to control the hydraulic oil fed from the hydraulic pump to hydraulic actuators of the work machine; and a detecting means for detecting the actual start-up moment of the hydraulic actuators;

wherein said controller includes:

function generating units, each of which has a reference function that incorporates the relationship between an electric manipulation signal and a command value to the corresponding electro-hydraulic transducing valve;

drivers adapted to respectively drive the electro-hydraulic transducing valves based on the outputs from the function generating units; and calibration computing units, each of which is adapted to correct the corresponding reference function by storing the command value sent to the corresponding electro-hydraulic transducing valve at the moment when the corresponding hydraulic actuator was actually started, as detected by said detecting means, computing a calibration deviation based on the difference between the stored command value and the provisional command value corresponding to an imaginary start-up moment of the hydraulic actuator associated therewith, said provisional command value set beforehand by using the reference function in the corresponding reference function generating unit, and setting the corrected function in the reference function generating unit by adding said calibration deviation to the reference function.

4. A work machine control apparatus as claimed in claim 3, wherein:

the detecting means for detecting the start-up moments of the hydraulic actuators of the work machine control apparatus includes:

a first pressure detector adapted to detect control valve return pressure generated in the return circuit from the control valves, and a second pressure detector adapted to detect load-sensing pressure at the load side; and each calibration computing unit is adapted to compute the differential pressure between a load-sensing pressure and a control valve return pressure of the corresponding control valve and regard the moment when the differential pressure exceeds a given, constant reference pressure that has been set slightly greater than zero as the actual start-up moment of the corresponding hydraulic actuator.

* * * * *